US006591995B1

(12) United States Patent
Grove

(10) Patent No.: US 6,591,995 B1
(45) Date of Patent: Jul. 15, 2003

(54) WALL MOUNTING SYSTEM AND BRACKET

(75) Inventor: Richard J. Grove, Loganville, GA (US)

(73) Assignee: DeKalb Tool & Die, Inc., Tucker, GA (US)

( * ) Notice: Subject to any disclaimer, the term of this patent is extended or adjusted under 35 U.S.C. 154(b) by 0 days.

(21) Appl. No.: 10/160,511

(22) Filed: Jun. 3, 2002

(51) Int. Cl.[7] ..... A47F 5/08
(52) U.S. Cl. ..... 211/87.01
(58) Field of Search ..... 211/87.01, 103, 211/70.6, 90.02, 90.01; 248/220.31, 220.41, 225.21

(56) References Cited

U.S. PATENT DOCUMENTS

| | | | | |
|---|---|---|---|---|
| 1,938,370 A | | 12/1933 | Bodkin | 248/19 |
| 2,498,842 A | | 2/1950 | Kuenne | 219/19 |
| 2,769,553 A | | 11/1956 | Horton | 211/87 |
| 2,814,894 A | | 12/1957 | Horton | 40/63 |
| 2,942,364 A | | 6/1960 | Horton | 40/63 |
| 2,974,918 A | | 3/1961 | Voigtlander | 248/201 |
| 3,163,392 A | | 12/1964 | Husted | 248/223 |
| 3,204,776 A | | 9/1965 | Brown et al. | 211/87 |
| 3,483,995 A | * | 12/1969 | Larson | 248/220.41 |
| 3,778,955 A | | 12/1973 | Close | |
| 4,138,019 A | | 2/1979 | Smith | |
| 4,205,815 A | | 6/1980 | Sauer et al. | 248/243 |
| 4,884,702 A | * | 12/1989 | Rekow | 211/90.02 |
| 4,932,538 A | | 6/1990 | Gambello | |
| 5,116,007 A | * | 5/1992 | Von Gunton et al. | 248/243 |
| 5,185,971 A | | 2/1993 | Johnson, Jr. | 52/36 |
| 5,205,524 A | * | 4/1993 | Cohen | 248/235 |
| 5,379,976 A | | 1/1995 | DeGirolamo | 248/221.2 |
| 5,531,415 A | | 7/1996 | Kallemeyn | 248/220.31 |
| 5,595,309 A | | 1/1997 | Bauer et al. | 211/59.1 |

* cited by examiner

*Primary Examiner*—Alvin Chin-Shue
*Assistant Examiner*—Sarah Purol
(74) *Attorney, Agent, or Firm*—Needle & Rosenberg, PC.

(57) ABSTRACT

A wall mounting system for commercial and residential uses is disclosed. The mounting system includes brackets which are each adapted to be securely and removably mounted in a substantially vertical mounting slots of a mounting body, such as, for example, a panel. At least a portion of the bracket is adapted for releasable engagement with one of the mounting slots. The bracket may be used to support a variety of articles thereon.

27 Claims, 9 Drawing Sheets

WALL MOUNTING SYSTEM AND BRACKET

BACKGROUND OF THE INVENTION

1. Field of the Invention

The present invention relates to mounting systems and brackets for use with mounting systems. More particularly, the present invention relates to wall mounting systems wherein brackets are securely and releasably mounted on a panel, such as a wall panel, so that various articles can be displayed or stored thereon.

2. Background Art

The prior art contains many examples of display and mounting systems that are capable of supporting various articles for storage or advertising purposes. Typical wall mounting systems that include brackets, or other display support structures, are commonly used in commercial establishments and residential homes to display or store various articles. Because of the wide demand for such wall mounting systems, inventors have expended great effort in designing and developing new and improved mounting systems. For example, U.S. Pat. No. 5,595,309 to Bauer et al.; U.S. Pat. No. 5,205,524 to Cohen; U.S. Pat. No. 4,932,538 to Gambello; U.S. Pat. No. 4,817,900 to Whittington et al.; U.S. Pat. No. 4,211,379 to Morgan et al.; and U.S. Pat. No. 4,205,813 to Sauer et al. disclose mounting systems which are indicative of the efforts made by prior art inventors. However, despite the past efforts of prior inventors, problems remain with respect to adequately securing the brackets or other support structures to wall mountable panels. More particularly, there has been a deficiency in adequately securing support brackets in all known prior art devices that employ detachable support brackets for display and support of articles. Thus there is a need for a mounting system in which a bracket may be securely affixed to a wall mountable panel and released therefrom only upon an operator's positive intervention, that is inexpensive to produce, and that has substantial strength and durability for supporting articles of various weights.

SUMMARY

The present invention meets this need by providing a bracket for use in a mounting body, such as, for example, a wall panel, that has an array of substantially vertical mounting slots. The bracket of the present invention has a planar body which has a rear portion of which at least a portion is adapted for releasable engagement with at least one of the vertical mounting slots. In one aspect, the rear portion of the bracket has an outwardly extending first mounting member having a lower edge and a spaced upper edge. The lower edge defines a first notch, formed intermediate a first corner of the lower edge and a spaced second corner of the lower edge, and a spaced second notch, formed intermediate the first notch and the second corner of the lower edge. The first notch has a seating surface. Adjacent portions of the first and second notches define at least a portion of a male retainer leg therebetween. Further, a portion of the second notch defines at least a portion of a lower tang member at the second corner of the lower edge.

The upper edge of the rear portion of the bracket defines an upper notch that is spaced from the first and second notches in the lower edge. The upper notch has opposed first and second side surfaces and a stepped base surface extending between the respective side surfaces. The stepped base surface forms a lower base surface and defines a shoulder surface that extends into the upper notch away from the lower base surface. The first side surface of the upper notch has a first distal end and the second side surface of the upper notch has a second distal end. In use, the seating surface of the first notch is preferably spaced from both the respective first and second distal ends of the upper notch a distance greater than a longitudinal slot length of one mounting slot of the panel.

Further, the male retainer leg may define a retainer tip and the lower tang member may define a tang tip. Preferably, the retainer tip of the male retainer leg is spaced from the shoulder surface of the upper notch a distance less than the longitudinal slot length. Also, it is preferred that the tang tip of the lower tang member is spaced from the lower base surface of the upper notch a distance less than the longitudinal slot length and is spaced from the shoulder surface of the upper notch a distance greater than the longitudinal slot length.

BRIEF DESCRIPTION OF THE FIGURES

These and other features and aspects of the present invention will become better understood with reference to the following description, appended claims, and accompanying drawings, where:

DETAILED DESCRIPTION OF THE INVENTION

Figure 1:
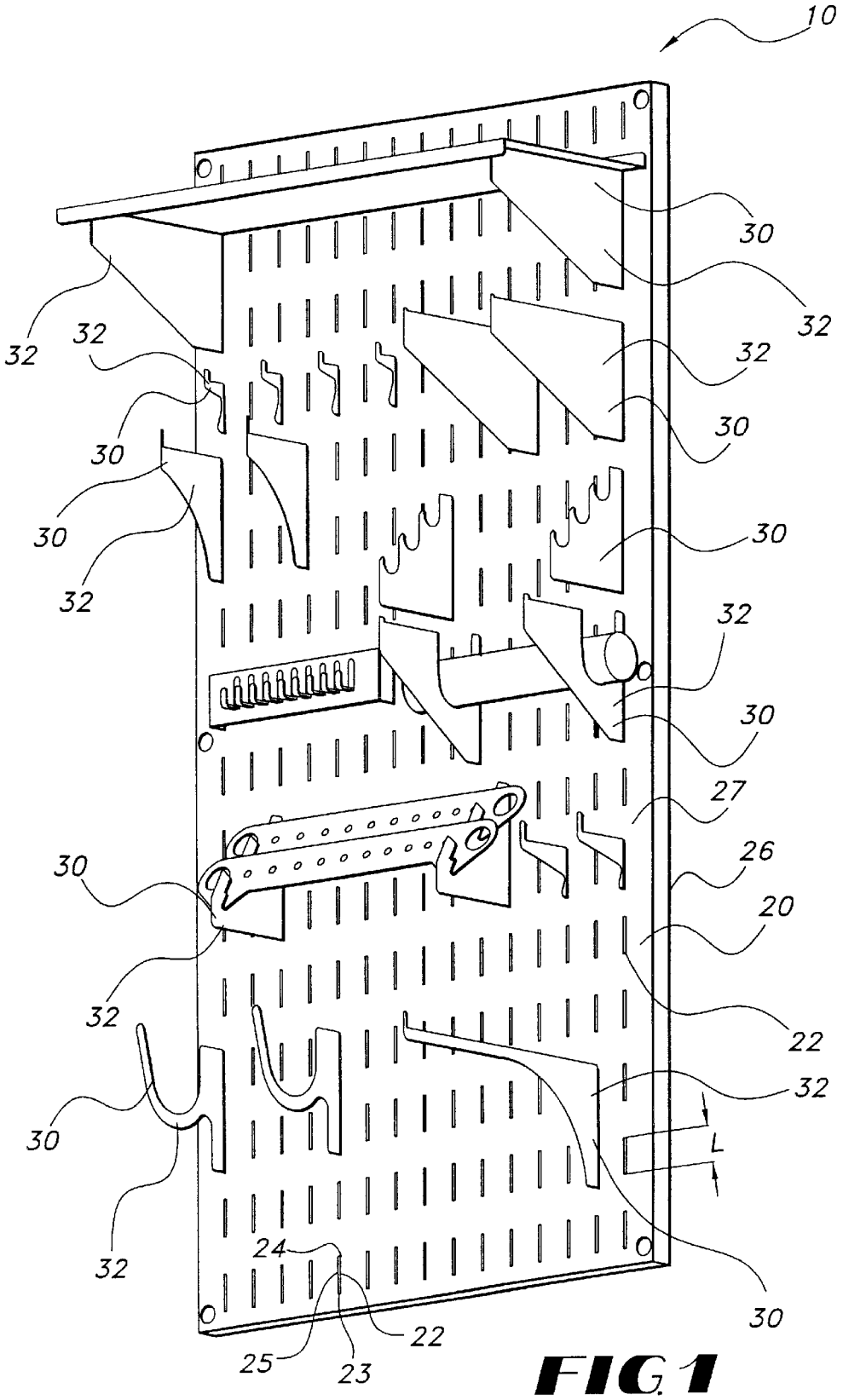
FIG. 1 is a perspective view of embodiments of a wall mounting system having a plurality of brackets releasably engaged to a mounting body having an array of substantially vertical mounting slots.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

The present invention comprises a wall mounting system 10 and a bracket 30 for use in such a wall mounting system 10, as shown generally in FIGS. 1–6. The bracket 30 of the present invention is adapted for supporting or displaying articles therefrom, but one skilled in the art will appreciate that the design features of the present invention are applicable for use in both residential and commercial wall mounting systems.

Referring first to FIG. 1, an exemplary embodiment of a wall mounting system 10 is shown. Here, the wall mounting system comprises a mounting body 20, such as, for example, a raised panel, that has an array of substantially vertical mounting slots 22, and at least one bracket 30 releasably engaged to at least one of the mounting slots 22. Each bracket 30 has a front portion 32 that has a conventional shape for display and/or support of articles. As one skilled in the art will appreciate, it is contemplated that the front portion 32 of each bracket may have any conventional shape adapted for support of any desired object or article therefrom. For example, as shown in FIG. 1, exemplary conventional shapes for the front portion 32 of the bracket 30 may include a "U" shaped hook, an angled hook, a clip support, a step support, a shelf support, and the like.

The brackets of the present invention are adapted for releasable engagement with at least one vertical mounting slot 22 of the mounting body 20. Each mounting slot 22 has a bottom end 23, a spaced top end 24, a longitudinal slot length L extending therebetween, and a circumferentially extending slot edge surface 25. Each bracket is preferably formed from a rigid material such as, for example, metal, plastic, polymers, or the like.

Figure 2:
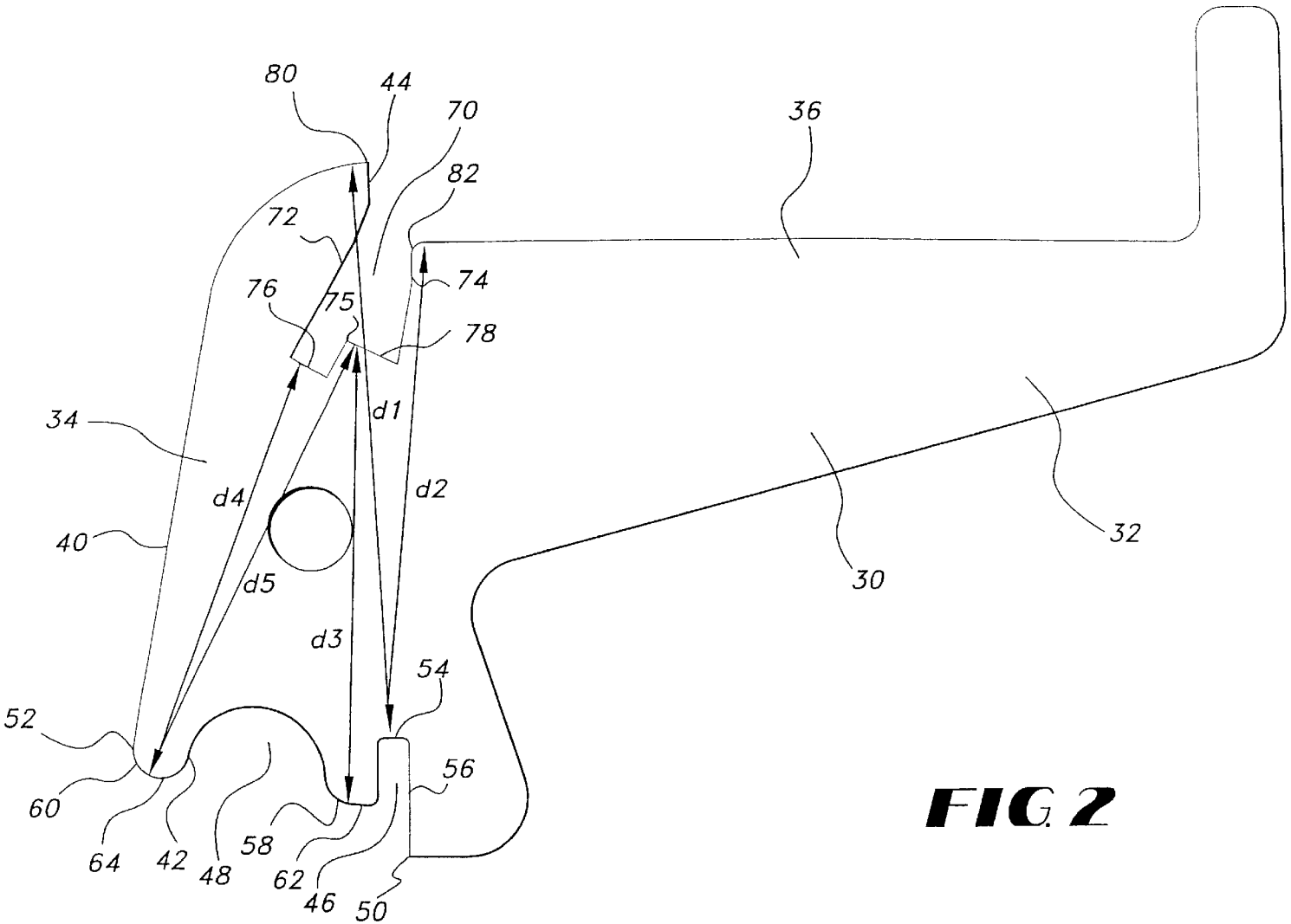
FIG. 2 is a side view of one embodiment of a bracket shown in FIG. 1 adapted for releasable engagement to one slot of the mounting body.

Referring now to FIG. 2, an exemplary embodiment of a bracket 30 for use in the wall mounting system 10 is shown. Here, the bracket 30 of the present invention has a planar body 36 which has a rear portion 34. The rear portion of the body has at least a portion that is adapted for releasable engagement with at least one of the vertical mounting slots 22. In one aspect, the rear portion 34 of the bracket has an outwardly extending first mounting member 40 that includes a lower edge 42 and a spaced upper edge 44. The lower edge 42 defines a first notch 46 and a spaced second notch 48. The first notch 46 is formed intermediate a first corner 50 of the lower edge and a spaced second corner 52 of the lower edge and the second notch 48 is formed intermediate the first notch 46 and the second corner 52 of the lower edge 42. The first notch 46 has a seating surface 54 and a side surface 56. Adjacent portions of the first and second notches define at least a portion of a male retainer leg 58 therebetween. Further, a portion of the second notch 48 defines at least a portion of a lower tang member 60 at the second corner 52 of the lower edge. Preferably, at least a portion of the second notch 48 between the male retainer leg and the lower tang member has a concave arcuate shape extending inwardly.

The upper edge 44 of the rear portion 34 of the body of the bracket 30 defines an upper notch 70 that is spaced from the first and second notches in the lower edge 42 of the rear portion. The upper notch 70 has opposed first and second side surfaces 72, 74 and a stepped base surface 75 that extends between the respective first and second side surfaces. The stepped base surface 75 forms a lower base surface 76 and defines a shoulder surface 78 that extends into the upper notch away from the lower base surface. The first side surface 72 of the upper notch has a first distal end 80 and the second side surface 74 of the upper notch has a second distal end 82. In use, the seating surface 54 of the first notch is preferably spaced from the first distal end 80 of the upper notch 70 a distance $d_1$ greater than a longitudinal slot length of one mounting slot of the mounting body 20 and is preferably spaced from the second distal end 82 of the upper notch 70 a distance $d_2$ greater than the longitudinal slot length.

Further, the male retainer leg 58 defines a retainer tip 62 and the lower tang member 60 defines a tang tip 64. The tang tip may have a rounded shape. Preferably, the retainer tip 62 of the male retainer leg is spaced from the shoulder surface 78 of the upper notch 70 a distance $d_3$ less than the longitudinal slot length. It is also preferred that the tang tip 64 of the lower tang member 60 is spaced from the lower base surface 76 of the upper notch 70 a distance $d_4$ less than the longitudinal slot length and is spaced from the shoulder surface 78 of the upper notch a distance $d_5$ greater than the longitudinal slot length.

Figure 3:
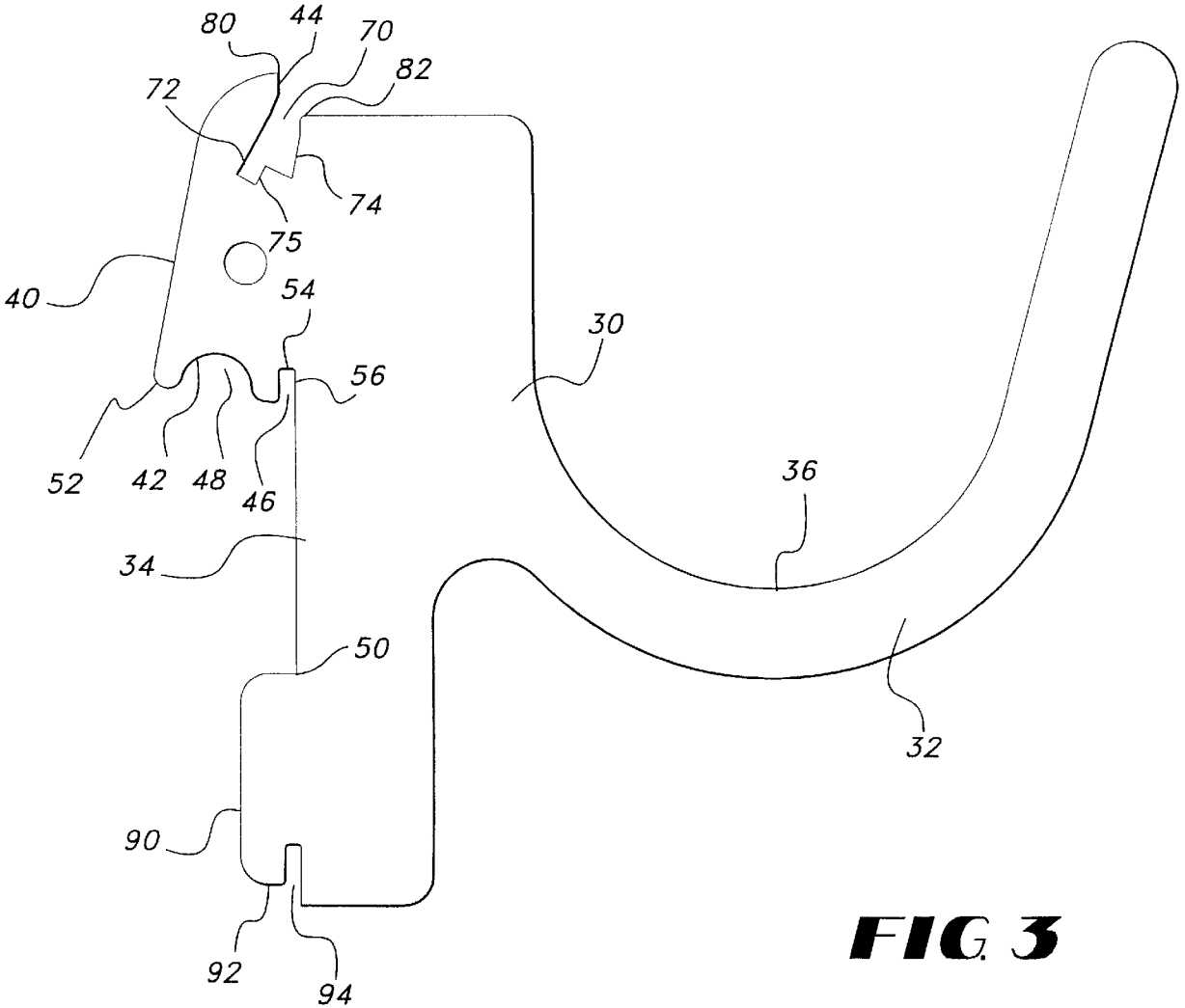
FIG. 3 is a side view of an alternate embodiment of a bracket shown in FIG. 1 adapted for releasable engagement to two slots of the mounting body.

Referring to FIG. 3, an alternate embodiment of a bracket 30 of the present invention is shown. In this embodiment, the rear portion 34 of the bracket includes an outwardly extending second mounting member 90. The second mounting member is spaced from the first mounting member 40 and, when oriented for insertion into the mounting member, the second mounting member 90 preferably underlies the first mounting member 40. The second mounting member 90 has a bottom edge 92 in which a third notch 94 is defined. Preferably, portions of the first notch 46 of the first mounting member and portions of the third notch 94 of the second mounting member are substantially co-planar. As one will appreciate, when the bracket 30 is engaged to the mounting body 20, portions of the first notch 46 of the first mounting member 40 will contact portions of the mounting body proximate one mounting slot and portions of the third notch 94 of the second mounting member 90 will contact portions of the mounting body proximate another, spaced, mounting slot.

Figure 4A:
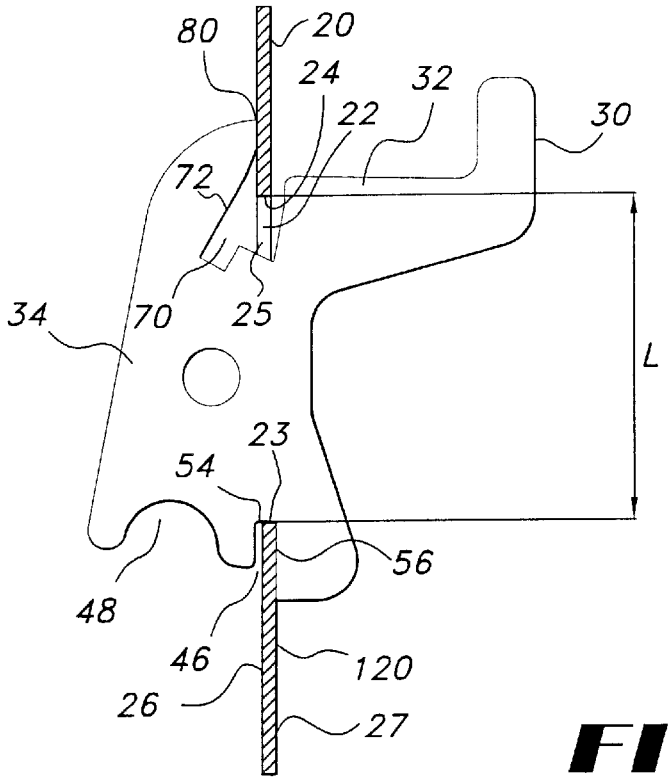
FIGS. 4A–4G are partial cut-away side views of the bracket shown in FIG. 1 when locked to the mounting panel, and during insertion and removal therefrom respectively.

Referring now to FIGS. 4A–4G, an exemplary bracket 30, such as the one shown in FIG. 2, is shown being disengaged from a mounting slot 22 within a mounting body 20. As one will appreciate, the bracket is moveable between an engaged position to a disengaged position in which the bracket is disconnected from the mounting body 20 upon application of directed force by an operator. In FIG. 4A, the bracket is shown in an engaged position in which a portion of the first side surface 72 of the upper notch 70 proximate the first distal end 80 is in contact with a portion of an inner surface 26 of the mounting body above the top end 24 of one mounting slot and at least a portion of the seating surface 54 of the first notch 46 is in contact with the slot edge surface 25 at the bottom end 23 of the mounting slot to restrict downward movement of the bracket relative to the mounting body. Further, in the engaged position, it is preferred that a portion of the side surface 56 of the first notch 46 be in contact with a portion of the outer surface 27 of the mounting body adjacent to and below the bottom end 23 of the mounting slot. One will appreciate that, in the engaged position, the bracket is securely affixed to the mounting body 20 and is releasable therefrom only upon an operator's active intervention.

Figure 4B:
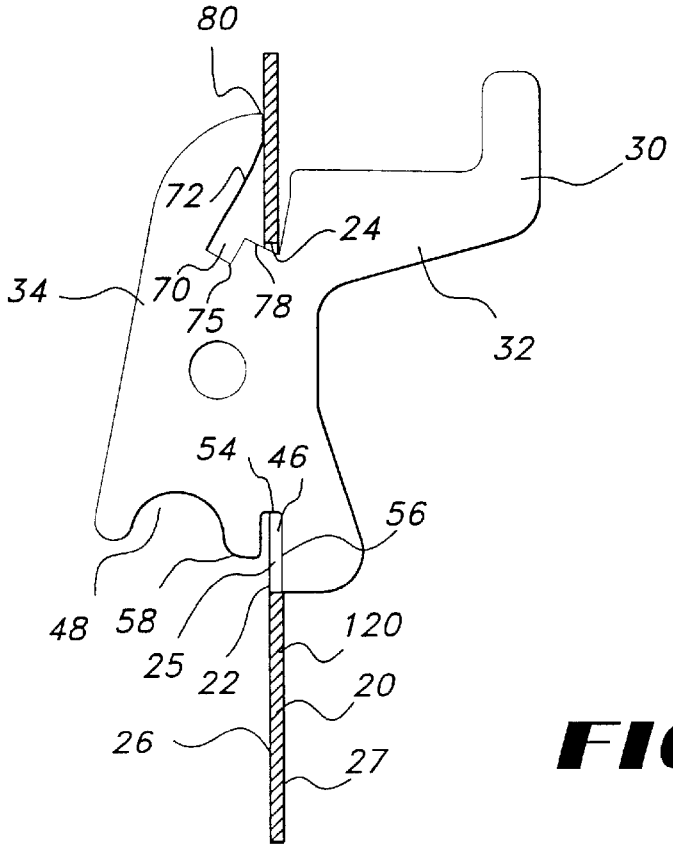
Figure 4C:
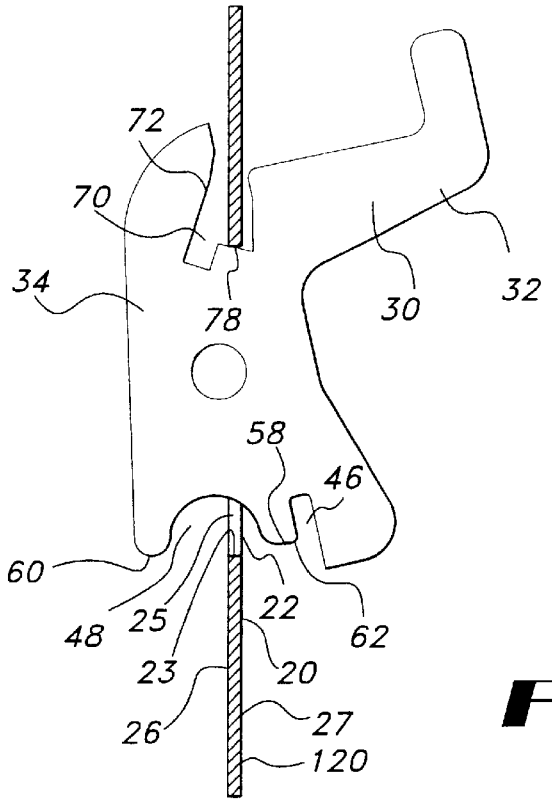

In FIGS. 4B–4G, the bracket 30 is shown being removed or disengaged from the mounting slot 22. First, as shown in FIGS. 4B and 4C, the bracket is raised so that a portion of the shoulder surface 78 of the upper notch 70 is brought into proximity to or contact with the slot edge surface 25 of the top end 24 of the mounting slot. In that position, because the retainer tip 62 of the male retainer leg 58 is spaced from the shoulder surface 78 of the upper notch a distance that is less than the longitudinal length of the mounting slot, the bracket may be rotated, counter-clockwise in the exemplified figures, so that the retainer tip 62 of the male retainer leg 58 can pass through the mounting slot 22 without striking or binding against the slot edge surface 25 of the bottom end 23 of the mounting slot.

Figure 4D:
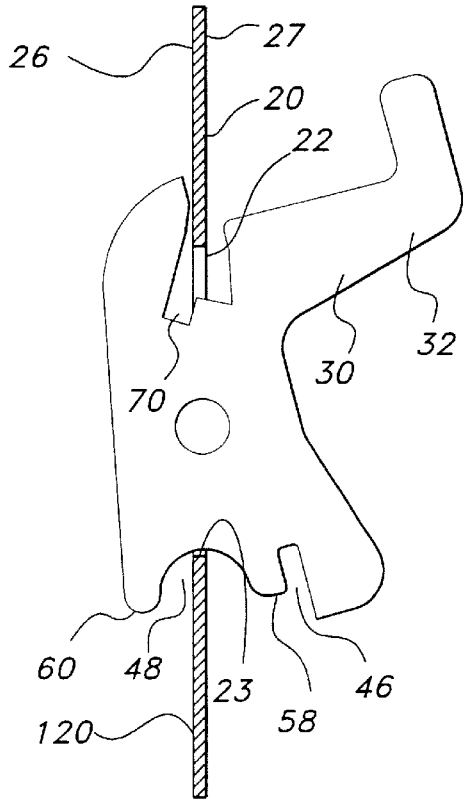
Figure 4E:
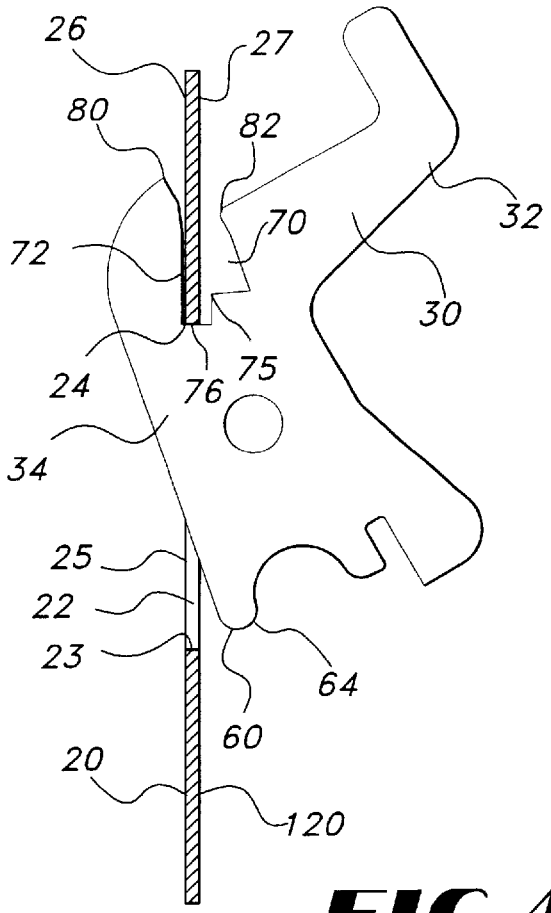
Figure 4F:
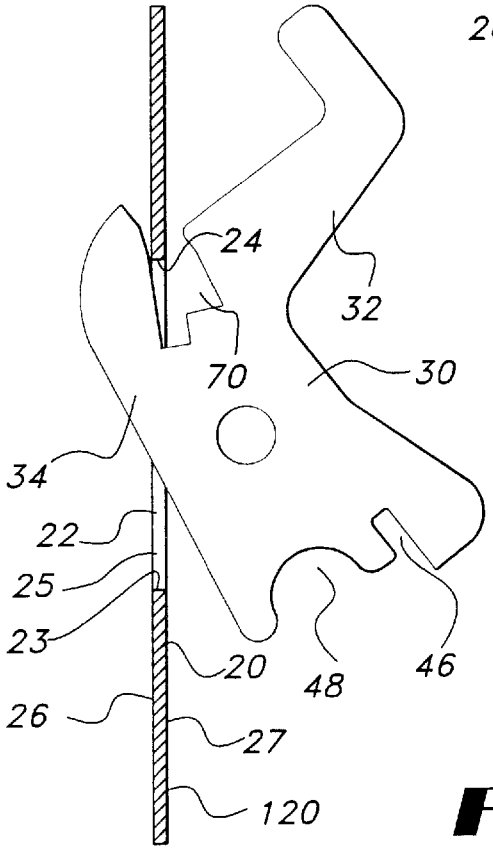
Figure 4G:
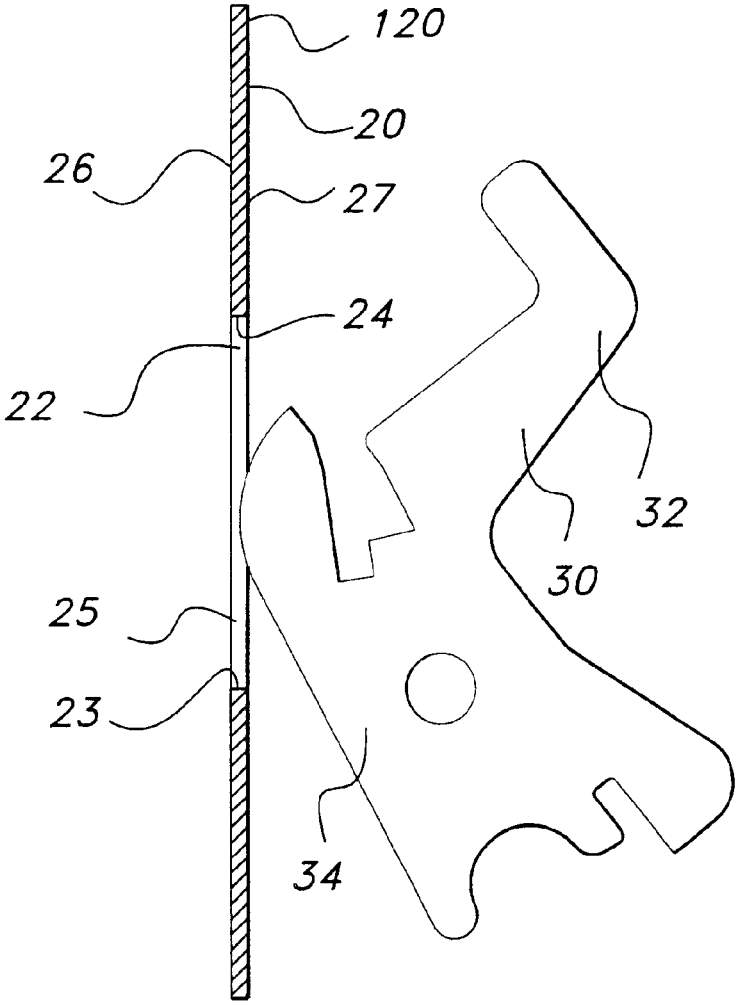

As shown in FIG. 4D, the bracket 30 is then lowered so that the bottom end 23 of the mounting slot is positioned within the second notch 48 of the lower edge 42. In this position, the top end 24 of the mounting slot 22 is disposed in the upper notch 70 and is spaced from the stepped base surface 75 of the upper notch 70. In FIG. 4E, the bracket 30 is again raised so that a portion of the lower base surface 76 of the upper notch is brought into proximity to or contact with the slot edge surface 25 of the top end 24 of the mounting slot. In that position, because the tang tip 64 of the lower tang member 60 is spaced from the lower base surface 76 of the upper notch a distance that is less than the longitudinal length of the mounting slot, the bracket may be continued to be rotated, counter-clockwise in the exemplified figures, so that the tang tip of the lower tang member can pass through the mounting slot 22 without striking or binding against the slot edge surface 25 of the bottom end 23 of the mounting slot. Finally, the bracket is subsequently lowered, as shown in FIGS. 4F and 4G; so that the top end 24 of the mounting slot is removed from within the upper notch 70 of the bracket. As one will appreciate, the bracket 30 may be engaged to the mounting body 20 be inverting the steps described above.

When the bracket 30 is in the engaged position and, as shown in FIG. 3, the bracket 30 included a second mounting member 90, portions of the second mounting member are in contact with portions of the panel proximate the bottom end 23 of one respective mounting slot 22 that is spaced from the mounting slot 22 to which the first mounting member 40 of the bracket is engaged. During removal of the bracket 30, when the bracket is initially raised so that a portion of the shoulder surface 78 of the upper notch is brought into proximity to or contact with the slot edge surface 25 of the top end 24 of the mounting slot, the second mounting member 90 is also raised so that the second mounting member overlies the respective mounting slot 22 (i.e., the bottom end 23 of respective mounting slot 22 is drawn clear of the third notch 94). Thus, upon the initial rotation of the bracket 30, the second mounting member 90 passes through the mounting slot 22. Subsequently, the first mounting member 40 of the bracket may be removed from the mounting body as described above.

Figure 5:
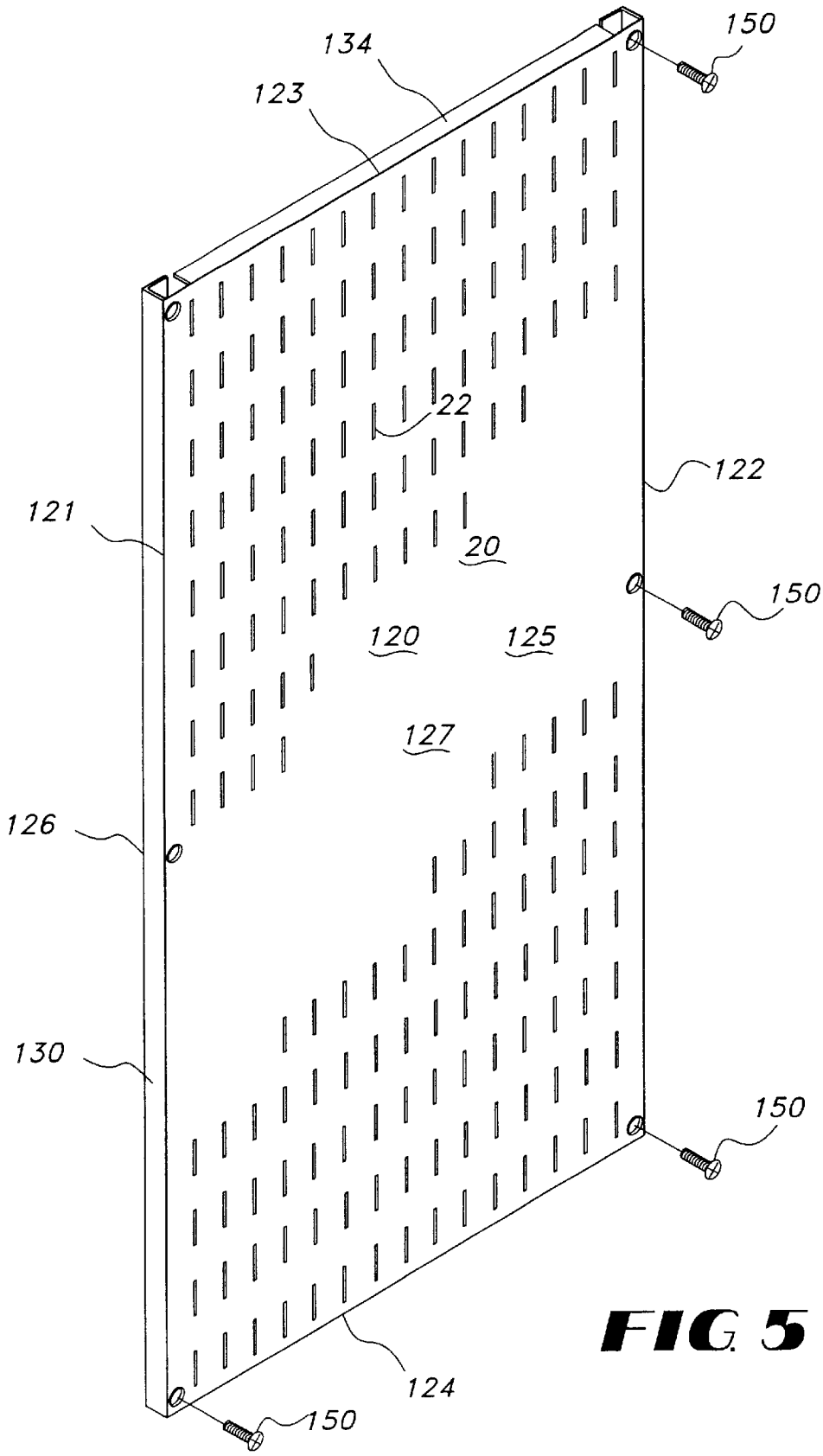
FIG. 5 is a partially exploded perspective view of one embodiment of a flanged mounting panel that may be used as a mounting body in the mounting system.
Figure 6:
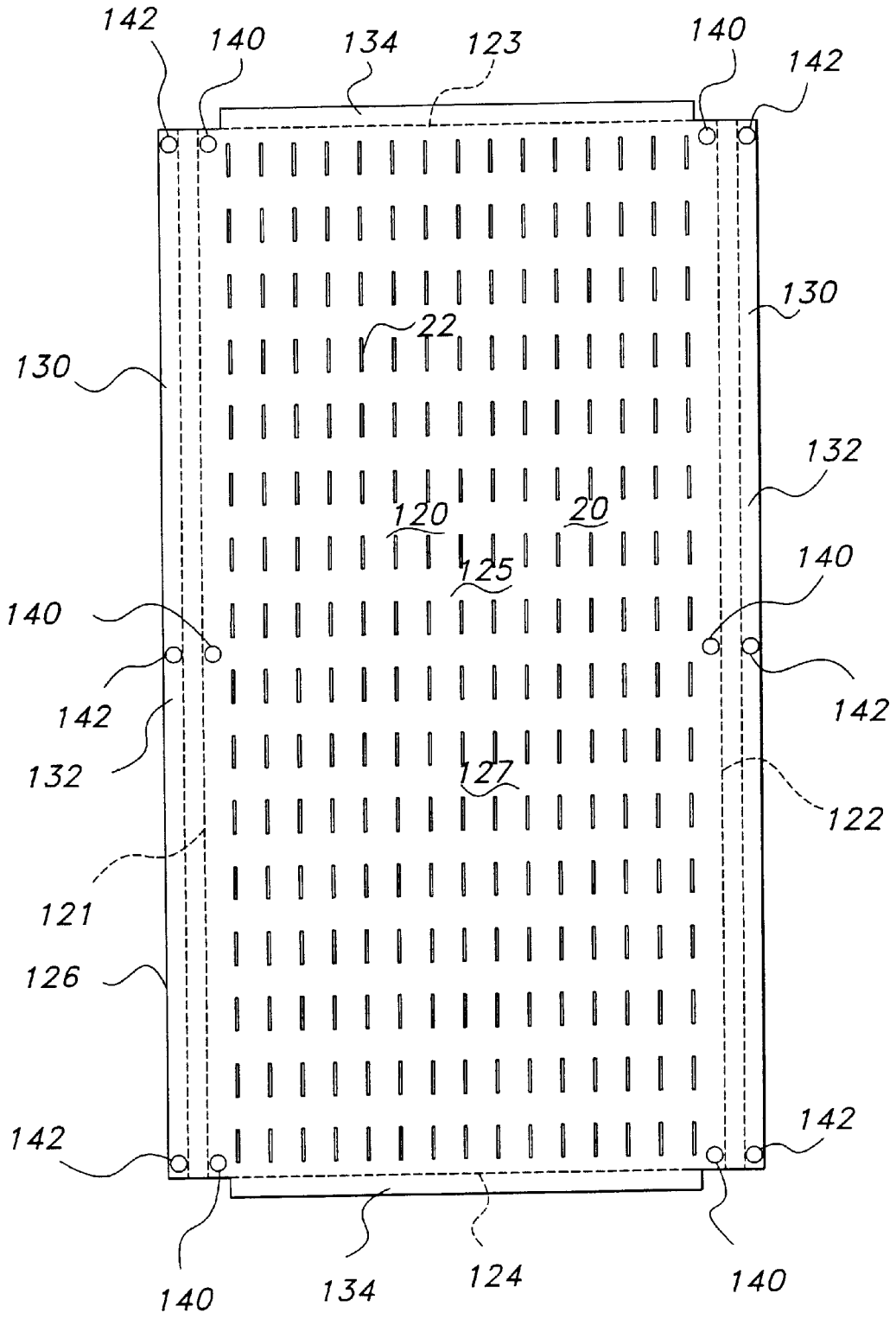
FIG. 6 is a perforated metal blank to be bent up to form the flanged mounting panel shown in FIG. 5.

Turning now to FIGS. 1, 5 and 6, the mounting body 20 of the wall mounting system 10 may comprise a conventional raised wall panel having the array of substantially vertical slots 22 therein. Such a conventional wall panel would typically have a conventional frame so that the actual panel surface is spaced from the wall surface. However, in FIGS. 1 and 5, one preferred embodiment of a mounting body 20 for the wall mounting system 10 is shown. Here, the mounting body 20 is a flanged mounting panel 120 that has a first edge 121, a spaced second edge 122, and a planar mounting body 125 extending between the first and second edges. The planar mounting body of the panel 120 has an inner surface 126, a spaced outer surface 127 and defines the plurality of vertical mounting slots 22. Preferably, the first and second edges 121, 122 of the panel 120 are parallel to each other and each of the vertical mounting slots 22 is formed so that it extends substantially parallel to the respective first and second edges.

The panel 120 also has a pair of integral L-shaped angular flange extensions 130. One of the angular flange extensions extends rearwardly away from each of the respective first and second edges. As the angular flange extension 130 extends rearwardly, a portion of the angular flange extensions proximate the respective first and second edges extends rearwardly substantially perpendicular the inner surface 126 of the panel 120. An end portion 132 of each of the angular flange extensions 130 extends substantially parallel to and faces toward the inner surface of the panel. Thus, in horizontal cross-section, the angular flange extensions 130 are substantially L-shaped. As one will appreciate, when portions of the respective end portions of the angular flange extensions are placed in contact with a mounting surface, the inner surface 126 of the panel 120 is spaced from the mounting surface.

The panel may also have a third edge 123 and a spaced fourth edge 124. The third edge and the fourth edge extend between the respective first and second edges. The first, second, third, and fourth edges define the boundaries of the planar mounting body 125. To increase the rigidity of the overall panel, the present invention may also include a least one integral planar flange 134. The planar flange 134 may extend rearwardly from a portion of the third edge 123 so that a portion of the planar flange extends rearwardly substantially perpendicular to the inner surface 126 of the panel 120. Preferably one planar flange 134 extends from a portion of each of the respective third and fourth edges 123, 124.

In order to removably connect the mounting panel 120 to the mounting surface, the panel of the mounting system may include a plurality of openings 140 defined in the planar mounting body 125 of the panel, a plurality of bores 142 defined in the respective angular flange extensions 130, and a plurality of fasteners 150. Preferably, the openings 140 in the mounting body of the panel are spaced about proximate the first and second edges 121, 122 of the panel. The bores 142 are formed in the respective end portion 132 of the respective angular flange extensions 130 so that each bore is co-axial with one opening in the planar mounting body. Each pair of co-axial openings and bores are sized and shaped for complementary receipt of one fastener 150. In other words, each fastener 150 is adapted to extend through one opening 140 of the planar mounting body 125 and one bore 142 of the respective angular flange extension 130 and into the mounting surface to secure the panel 120 to the mounting surface.

As one skilled in the art will appreciate, the embodiment of the mounting panel 120 shown in FIG. 5 may be preferably be formed from a rigid material such as, for example, metal, plastic, polymers, or the like. If metal is used, a perforated metal blank, such as the one shown in FIG. 6, may be bent up to form the flanged mounting panel 120 shown in FIG. 5.

Although the illustrative embodiments of the present disclosure have been described herein with reference to the accompanying drawings, it is to be understood that the disclosure is not limited to those precise embodiment, and that various other changes and modifications may be affected therein by one skilled in the art without departing from the scope of spirt of the disclosure. All such changes and modifications are intended to be included within the scope of the disclosure as defined by the appended claims.

What is claimed is:

1. A mounting system, comprising:

a) a panel having an array of substantially vertical mounting slots; and b) a bracket having a planar body, the planar body having a rear portion, at least a portion of the rear portion being adapted for releasable engagement with one of the mounting slots, the rear portion having a outwardly extending first mounting member, the first mounting member having a lower edge and a spaced upper edge, the lower edge defining a first notch and a spaced second notch therein, the first notch being formed intermediate a first corner of the lower edge and a spaced second corner of the lower edge, the second notch being formed intermediate the first notch and the second corner of the lower edge, adjacent portions of the first and second notches defining at least a portion of a male retainer leg therebetween, a portion of the second notch defining at least a portion of a lower tang member at the second corner of the lower edge, the upper edge of the rear portion defining an upper notch spaced from the first and second notches, the upper notch having opposed first and second side surfaces and a stepped base surface extending therebetween, the stepped base surface forming a lower base surface and defining a shoulder surface extending into the upper notch and away from the lower base surface.

2. The mounting system of claim 1, wherein a least a portion of the second notch has a concave arcuate shape.

3. The mounting system of claim 1, wherein each mounting slot has a longitudinal slot length.

4. The mounting system of claim 3, wherein the first notch has a seating surface, wherein the first side surface of the upper notch has a first distal end and the second side surface of the upper notch has a second distal end, wherein the seating surface of the first notch is spaced from the first distal end of the upper notch a distance greater than the longitudinal slot length.

5. The mounting system of claim 4, wherein the seating surface of the first notch is spaced from the second distal end of the upper notch a distance greater than the longitudinal slot length.

6. The mounting system of claim 4, wherein the male retainer leg has a retainer tip, and wherein the retainer tip of the male retainer leg is spaced from the shoulder surface of the upper notch a distance less than the longitudinal slot length.

7. The mounting system of claim 6, wherein the lower tang member has a tang tip, and wherein the tang tip of the lower tang member is spaced from the lower base surface of the upper notch a distance less than the longitudinal slot length.

8. The mounting system of claim 7, wherein the tang tip of the lower tang member is spaced from the shoulder surface of the upper notch a distance greater than the longitudinal slot length.

9. The mounting system of claim 1, wherein the panel has a planar mounting surface having an outer surface and a spaced inner surface, wherein each mounting slot has a bottom end, a spaced top end, and a circumferentially extending slot edge surface, and wherein the bracket is movable between an engaged position, in which at least a portion of the seating surface of the first notch is in contact with the slot edge surface at the bottom end of one mounting slot to restrict downward movement of the bracket relative to the panel and a portion of the first side surface proximate the first distal end of the upper notch is in contact with a portion of the inner surface of the panel above the top end of the mounting slot, to a disengaged position, in which the bracket is disconnected from the panel.

10. The mounting system of claim 9, wherein the first notch has a side surface, and wherein, in the engaged position, a portion of the side surface is in contact with a portion of the outer surface of the panel adjacent to and below the bottom end of the mounting slot.

11. The mounting system of claim 9, wherein the rear portion of the bracket includes an outwardly extending second mounting member spaced from the first mounting member, the second mounting member having a third notch defined in a bottom edge, the third notch of the second mounting member substantially co-planar to the first notch of the first mounting member.

12. The mounting system of claim 11, wherein, in the engaged position, portions of the second mounting member are in contact with portions of the panel proximate the bottom end of one mounting slot that is spaced from the mounting slot to which the first mounting member of the bracket is engaged.

13. The mounting system of claim 1, wherein the panel has at least a first edge and a spaced second edge, and a planar mounting surface extending between the first and second edges, the planar mounting surface having an inner surface and a spaced outer surface, the panel further comprising a pair of integral L-shaped angular flange extensions, one angular flange extension extending rearwardly from each of the respective first and second edges of the panel so that a portion of the angular flange extension extends rearwardly substantially perpendicular to the inner surface of the panel and an end portion of the angular flange extension extends substantially parallel to the inner surface of the panel, whereby the inner surface of the panel is spaced from a mounting surface when portions of the respective end portions of the angular flange extensions contact the mounting surface.

14. The mounting system of claim 13, wherein the panel has a third edge and a spaced fourth edge, each of the third and fourth edges extending between the respective first and second edges of the panel, the panel further comprising a pair of integral planar flanges, one planar flange extending rearwardly from each of the respective third and fourth edges of the panel so that a portion of the planar flange extends rearwardly substantially perpendicular to the inner surface of the panel.

15. The mounting system of claim 14, wherein the planar mounting surface defines a plurality of spaced openings proximate the respective first and second edges, wherein each of the respective end portions of the angular flange extensions defines at least one bore extending through the angular flange extension, wherein one opening in the planar mounting surface is co-axial with each bore in the angular flange extension.

16. The mounting system of claim 15, further comprising a plurality of fasteners for securing the panel to the mounting surface, each fastener adapted to extend through one opening of the planar mounting surface and one bore of the angular flange extension and into the mounting surface.

17. The mounting system of claim 13, wherein the first and second edges of the panel are parallel, and wherein each of the vertical mounting slots extends parallel to the first and second edges.

18. The mounting system of claim 13, wherein the panel is formed from a single sheet of metal.

19. The mounting system of claim 13, wherein the panel is formed from a rigid polymer.

20. A bracket for releasable engagement with at least one vertically mounting slot of a mounting body, each mounting slot having a longitudinal length, the bracket comprising a planar body, the planar body having a rear portion, at least a portion of the rear portion being adapted for releasable engagement with one of the mounting slots, the rear portion having a outwardly extending first mounting member, the first mounting member having a lower edge and a spaced upper edge, the lower edge defining a first notch and a spaced second notch therein, the first notch being formed intermediate a first corner of the lower edge and a spaced second corner of the lower edge, the second notch being formed intermediate the first notch and the second corner of the lower edge, adjacent portions of the first and second notches defining at least a portion of a male retainer leg therebetween, a portion of the second notch defining at least a portion of a lower tang member at the second corner of the lower edge, the upper edge of the rear portion defining an upper notch spaced from the first and second notches, the upper notch having opposed first and second side surfaces and a stepped base surface extending therebetween, the stepped base surface forming a lower base surface and defining a shoulder surface extending into the upper notch and away from the lower base surface.

21. The bracket of claim 20, wherein a least a portion of the second notch has a concave arcuate shape.

22. The bracket of claim 20, wherein the first notch has a seating surface, wherein the first side surface of the upper notch has a first distal end and the second side surface of the upper notch has a second distal end, wherein the seating surface of the first notch is spaced from the first distal end of the upper notch a distance greater than the longitudinal length of the mounting slot.

23. The bracket of claim 22, wherein the seating surface of the first notch is spaced from the second distal end of the upper notch a distance greater than the longitudinal length of the mounting slot.

24. The bracket of claim 22, wherein the male retainer leg has a retainer tip, and wherein the retainer tip of the male retainer leg is spaced from the shoulder surface of the upper notch a distance less than the longitudinal length of the mounting slot.

25. The bracket of claim 24, wherein the lower tang member has a tang tip, and wherein the tang tip of the lower tang member is spaced from the base surface of the upper notch a distance less than the longitudinal length of the mounting slot.

26. The bracket system of claim 25, wherein the tang tip of the lower tang member is spaced from the shoulder surface of the upper notch a distance greater than the longitudinal length of the mounting slot.

27. The mounting system of claim 20, wherein the rear portion of the bracket includes an outwardly extending second mounting member spaced from the front mounting member, the second mounting member having a third notch defined in a bottom edge, the third notch of the second mounting member substantially co-planar to the first notch of the first mounting member.

* * * * *